United States Patent [19]

Hogan et al.

[11] 4,085,632

[45] Apr. 25, 1978

[54] SCREW CAP OPENER

[75] Inventors: Jesse M. Hogan; Violet L. Hogan, both of Vivian, La.

[73] Assignee: Kap-Key, Inc., Vivian, La.

[21] Appl. No.: 759,588

[22] Filed: Jan. 4, 1977

[51] Int. Cl.[2] ..... B67B 7/36

[52] U.S. Cl. ..... 81/3.3 R

[58] Field of Search ..... 81/3.3 R, 3.3 A, 3.4

[56] References Cited

U.S. PATENT DOCUMENTS

| | | | |
|---|---|---|---|
| 1,837,257 | 12/1931 | Eames | 81/3.3 R |
| 1,841,270 | 1/1932 | Aeschbach et al. | 81/3.3 R |
| 2,671,362 | 3/1954 | Wilson | 81/3.3 R |
| 2,810,311 | 10/1957 | Smith | 81/3.4 |
| 3,143,904 | 8/1964 | Yerkes | 81/3.4 |
| 3,760,657 | 9/1973 | Muir et al. | 81/3.4 |

*Primary Examiner*—Al Lawrence Smith
*Assistant Examiner*—James G. Smith
*Attorney, Agent, or Firm*—Clarence A. O'Brien; Harvey B. Jacobson

[57] ABSTRACT

A screw cap opener for jars and the like having screw caps or lids thereon consisting of a plastic holder preferably made of PVC-type material in various colors. Two nickel plated metal blades are mounted in the plastic support holder at an angle to each other to form a V-shaped gripping structure. One of the blades has a smooth edge while the second blade edge has sawteeth formed therein. Because of the V-shaped arrangement of the blades jar lids of various sizes in the normal range encountered in everyday use may be readily accommodated.

4 Claims, 10 Drawing Figures

SCREW CAP OPENER

BACKGROUND OF THE INVENTION

1. Field of the Invention

This invention relates generally to devices for gripping and holding screw caps on jars and the like in order to enable a user to easily remove same.

2. Description of the Prior Art

A common problem with known type screw cap removers is that they usually are unduly complicated and require a large number of component parts. Also, most of the known devices require some maintenance and have a limited useful life.

Another problem with known type devices is that they are not readily manufactured at low cost in order to mass produce same for large scale distribution and sale at a low price.

A further problem with known type devices is that often times the gripping structure for the lid or cap is of material other than metal and fails to hold up for long periods of use without maintenance.

Known prior art patents which may be pertinent to this invention are as follows U.S. Pat. Nos.:

1,837,257
2,671,362
1,841,270
2,810,311

None of these known prior art devices offers the new and unique features of the invention disclosed herein.

SUMMARY OF THE INVENTION

An object of the present invention is to provide a screw cap opener of simple construction which is relatively maintenance free.

Another object of the present invention is to provide a screw cap opener mountable underneath conventional type kitchen cabinets for ready access by a user and having a body structure of PVC plastic and metal blades held by said support in a V-shaped manner for gripping screw caps of various diameters.

A further object of this invention is to provide a screw cap opener device of extruded plastic material of various colors having two blades supported therein in a V-shaped position, one blade being of a smooth edge with the second blade having sawteeth formed therein, both blades being nickel plated for rust prevention.

A still further object of this invention is to provide a relatively inexpensive screw cap opener of plastic with metal blades which is relatively maintenance free.

The screw cap opener device of this invention comprises an extruded PVC plastic holder which is provided with appropriate apertures therein for the mounting of same underneath conventional type kitchen cabinets and the like for easy access and use thereof by a person desiring to open a screw cap jar or can.

Another important feature of this device is that two nickel plated metal blades are provided set in a V-shape in a plastic holder. One of the blades has a smooth edge while the second blade has a number of teeth provided thereon. The blades are mounted in the holder at an angle of approximately 40° from the center line through the device and are approximately 5⅜ inches apart at the front and approximately 5/16 inch apart at the back. This angle and distance spacing will permit the entire range of conventional type screw cap tops in use today to be readily and easily opened by this device.

Normally, the teeth of the sawtooth blade will point toward the rear of the device and the mounting holes in this tooth blade are offset a slight amount relative to the center line of the blade and relative to the holes in the smooth blade so that the blades cannot be misassembled, one for the other, or the tooth blade assembled backwardly in the holder.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
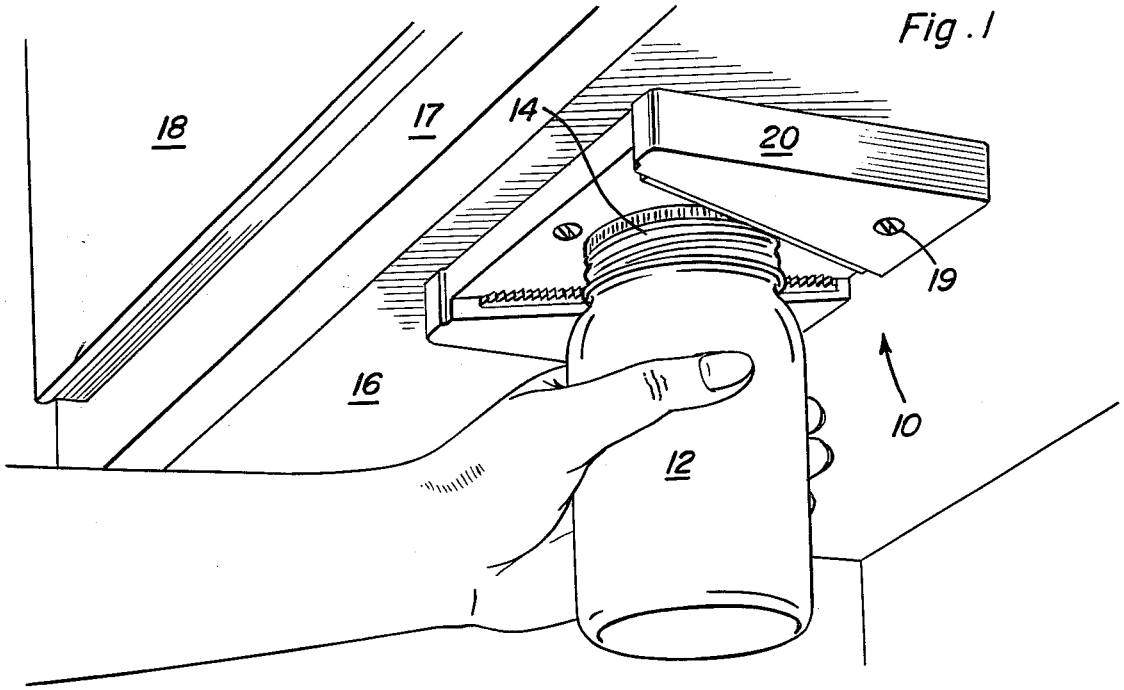
FIG. 1 is a perspective view of the device as in use.

Referring to FIG. 1 of the drawings, reference numeral 10 indicates the screw cap opener of this invention as mounted underneath a conventional-type kitchen cabinet. As shown, a user is about to open the jar 12 having a screw cap 14 thereon. The base of the cabinet 16 is clearly shown together with the front panel of the cabinet 17 and a door 18 for the cabinet. The opener structure is formed of extruded PVC type plastic material and has side triangular portions 20 integral with a flat main body portion 22. Common-type wood screws 19 normally are used to fasten the holder to the base of the cabinet. The portions 20 of the holder are quite close together at the rear of the device while providing a relatively large opening at the front thereof. The arrangement is such that the front opening with the blades inserted is approximately 5⅜ inches apart while the rear of the blades is approximately 5/16 inch apart at the back of the holder, The blades are mounted so as to be each at an angle of approximately 40° from the center line taken at the middle of the device and extending from the front to the back thereof.

Figure 2:
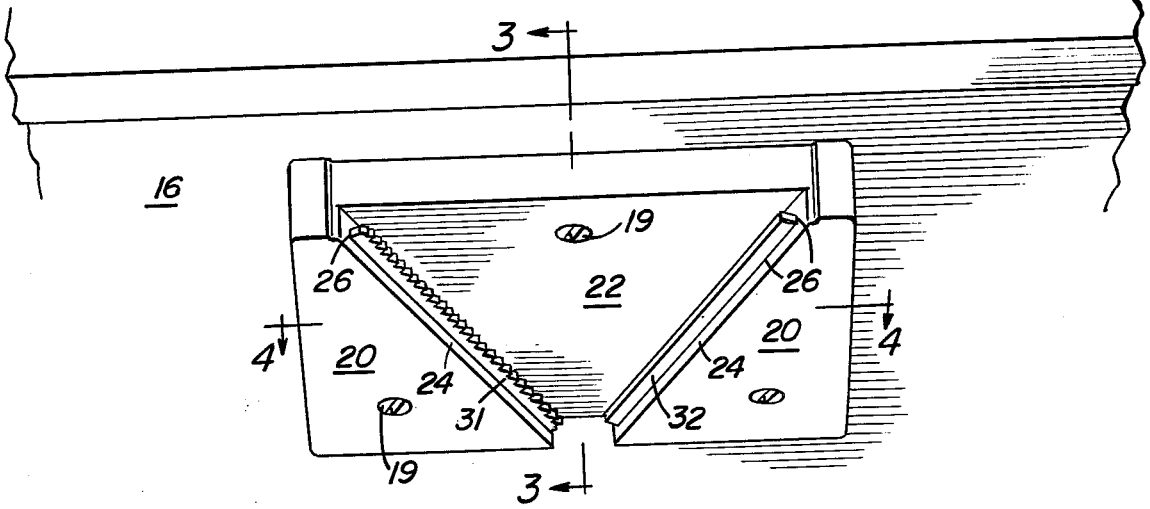
FIG. 2 is a perspective view from the front looking up at an overhead shelf mounting of the device.
Figure 3:
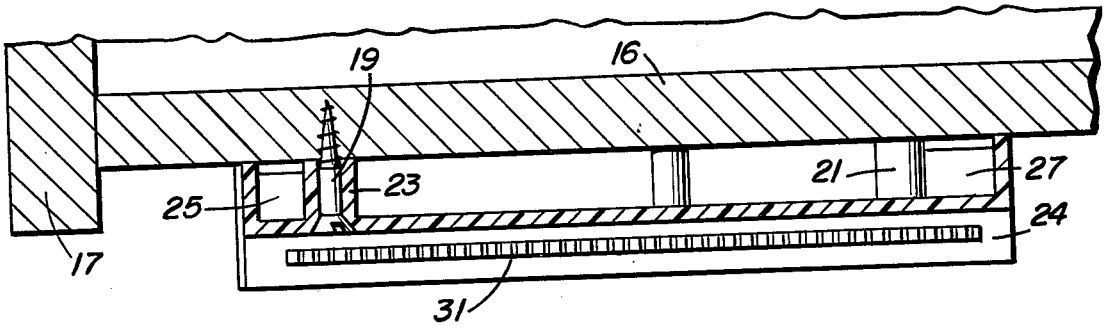
FIG. 3 is a cross-sectional view taken generally along line 3—3 of FIG. 2.
Figure 4:
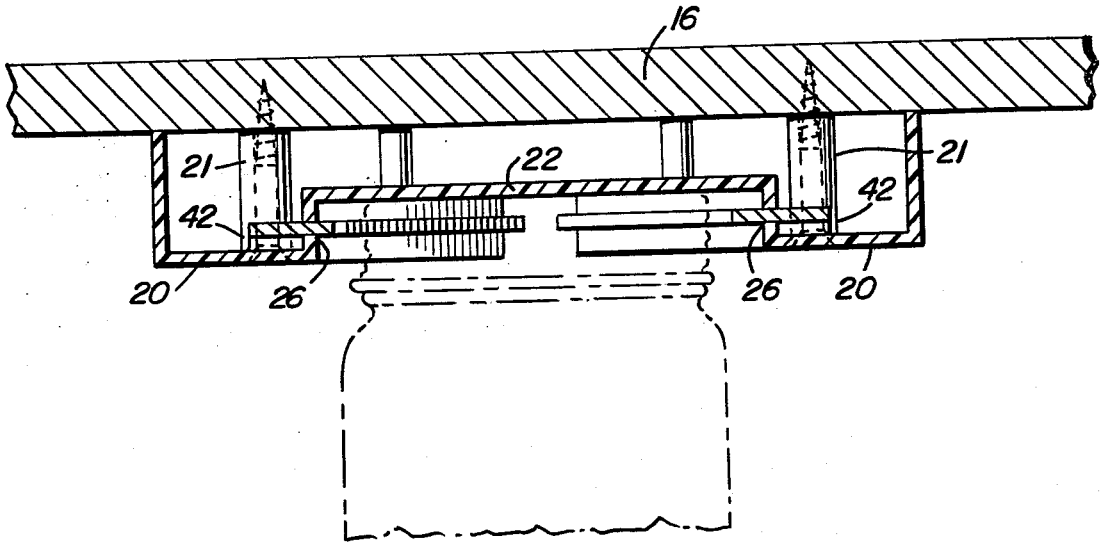
FIG. 4 is a cross-sectional view taken generally along line 4—4 of FIG. 2.
Figure 5:
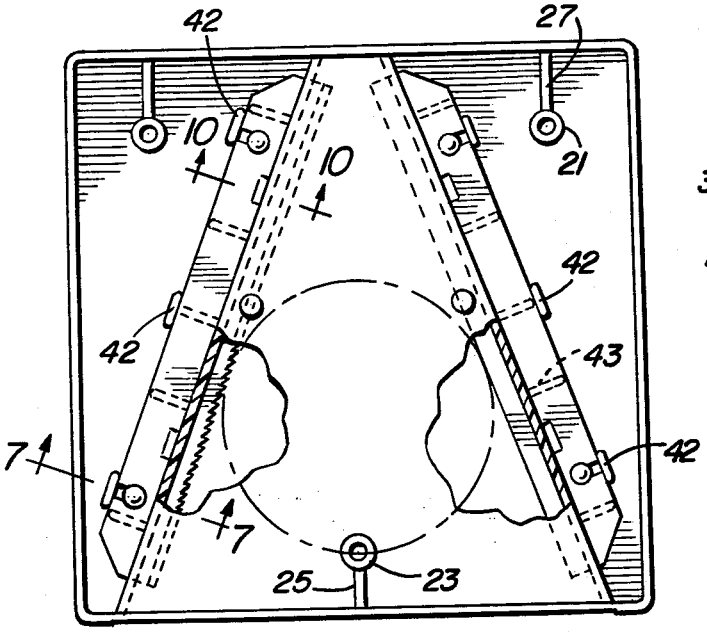
FIG. 5 is a top plan view, partly broken away, of the device per se.

The left blade, as viewed from the front in FIG. 2, is normally provided with sawteeth or a serrated edge thereon. The right blade 32 is normally provided with a smooth flat edge 34. It has been discovered that this arrangement is far superior to using two flat edged blades which have a tendency to slip and fail to completely and firmly hold the screw cap, while if both blades are provided with teeth, it is not possible to wedge the cap into the V as far and as well as it is with just one blade having teeth and the other one being of smooth edge. Also, the teeth of blade 31 slant toward the rear of the device for better gripping and holding action. In normal operation a user will insert the screw cap lid into the V as far as it will easily go, and then with a slight twist and an additional push, the cap can be wedged in a little more with the smooth edged blade permitting this additional movement of the cap relative to the overall device which would not be possible if the smooth blade was replaced by a toothed one. Once the cap is firmly wedged between the V positioned blades, then the user may twist the body of the jar and easily unscrew same from the cap.

Each body portion 20 is provided mid-way thereof along the V slot side 24 with longitudinal apertures 26 for reception of the metal blades. The metal blades, best seen in FIGS. 8 and 9, consist of the tooth blade 31 with the teeth 33, normally provided, facing in a backward direction when proper assembled in the device. Mounting slots 35 are provided along the opposite edge of the tooth blade which open into the mounting and holding holes 37. These holes are slightly offset from the center line of the blade and moved approximately one-fourth inch towards the back of said blade in order to prevent possible incorrect assembly of the blade in the holder during the manufacturing process. In other words, the holes are so positioned that there is only one possible manner in which the blade may be inserted in the holder structure and obviously this one correct position is the desired one. The smooth blade 32 having the flat edge 34 provided thereon also is provided with mounting slots 36 and mounting and holding holes 38. Since the smooth edged blade may be inserted in either direction without affecting the operation thereof, the holes and slots may be centered therewith so during assembly it may be rapidly positioned without regard to which end is toward the rear, etc. The spacing between holes 38 is less than the spacing between holes 37 of the toothed blade so that the blades cannot be interchanged in mounted position by mistake.

As mentioned above, the holder is preferably extruded of PVC type plastic in various colors and has some specific mounting apertures and strengthening and bracing partitions provided therein. The front center mounting hole is strengthened and reinforced by a tubular member 23 provided internally of the holder with further bracing provided by the partition 25 which extends between said tubular member 23 and the front edge of the holder. Similarly, the two rear mounting apertures have tubular portions 21 provided therefor with bracing partitions 27 extending between these tubular members and the rear of the holder. The molding and extrusion dies will be appropriately designed so that these apertures and strenghening members will be formed in the overall device as extruded. Likewise, the slots 26 will be formed in the members 20 during this extrusion process.

Figure 6:
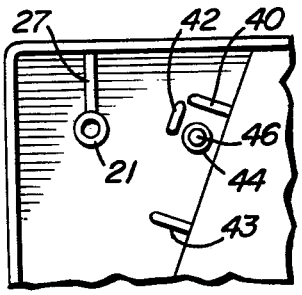
FIG. 6 is an inside corner view from the top showing the alignment and holding structure for the gripping sawtooth blade.
Figure 7:
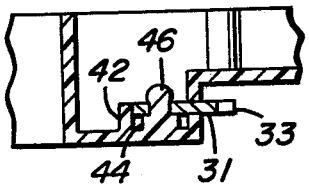
FIG. 7 is a view taken generally along line 7—7 of FIG. 5 showing the blade alignment pin in cross section.

Looking at FIGS. 6 and 7, the alignment ridges 40 and 42 may be clearly seen. The alignment ridges 42 prevent the blades from being inserted further than is proper into the members 20. Also, short ridges 43 support the flat back surface of the respective blades and at the same height as the bottom of the slots 26. Mounting and alignment pins 44 are also appropriately formed during the extrusion process with a reduced diameter extension projection 46 at the top thereof for snap-like reception within the holes 37 and 38 of the respective blades.

Figure 8:
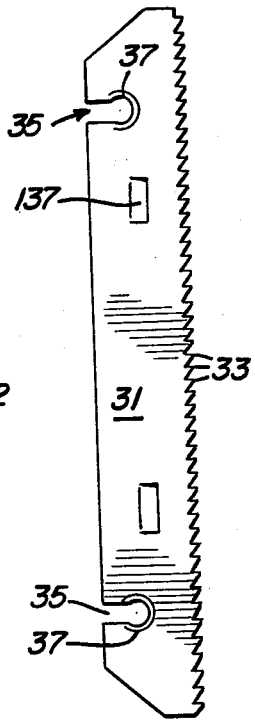
FIG. 8 is a top plan view of the slanted tooth gripping blade.
Figure 9:
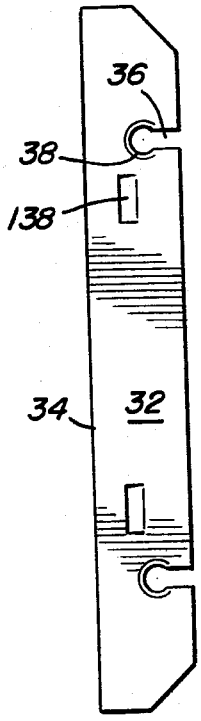
FIG. 9 is a top plan view of the plain edged gripping blade.
Figure 10:
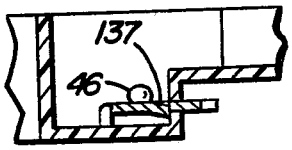
FIG. 10 is a cross-section taken generally along line 10—10 of FIG. 5 showing the blade retaining lug.

Looking at FIGS. 8, 9 and 10, retaining lug deformations 137, 138 for the respective blades may be seen. As the blades are forced inwardly in the longitudinal apertures 26 of the body portions 20 during assembly, the pair of retaining lugs on each blade will be slightly compressed into the associated blade until the lug clears the inside of the body portions adjacent the apertures 26, the lugs spring outwardly again to positively retain the blades in mounted and assembled position.

As can be seen from the above description, this screw cap opener device is relatively easily manufactured, is permanently secured together into one compact, permanent unit, and then may be easily distributed and sold for installation by the average homeowner underneath his kitchen cabinets or where most convenient. The device being of extruded plastic permits the mass production of same with the units being substantially identical in dimension and operation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In an opener for containers having screw caps thereon, the opener having opposing body portions which have facing planar side walls disposed at an angle to each other to form a V-shaped wedge opening for receiving screw caps of varying dimensions, the improvement comprising:

a first blade member replaceably held within a first elongated slot in one of said side walls, the first blade member having angled tooth-like projections extending therefrom into the wedge opening, the first blade member being disposed in said slot with the projections facing toward the rear of the wedge opening, the first blade member having spaced alignment apertures formed along the length thereof, the alignment apertures being offset from the longitudinal axis of the first blade member to prevent inverted assembly of the first blade member within the first elongated slot;

a second blade member replaceably held within a second elongated slot in the other of said side walls, edge surfaces of the second blade member extending into the wedge opening being substantially planar, the second blade member having spaced alignment holes formed along the length thereof, the alignment holes being centered along the longitudinal axis of the second blade member, the distance between the alignment holes in said second blade member being different from the distance between the alignment apertures in said first blade member;

alignment ridges formed on the respective body portions of the opener and spaced from the respective side walls for abutting edge portions of the respective first and second blade members to locate said blade members in a predetermined relation to the slots in said side walls;

support ridges formed on the respective body portions of the opener between the alignment ridges and the respective slots, the support ridges being of a height less than the alignment ridges and abutting the respective blade members along planar surfaces thereof to support said blade members, distal surface portions of the support ridges being aligned with edge portions of the slots nearest to surfaces of the body portions from which the support ridges extend; and, mounting pins formed on the respective body portions of the opener between the alignment ridges and the respective slots, upper portions of each of the mounting pins opposite the first slot being received within the alignment apertures formed in the first blade member, upper portions of each of the mounting pins opposite the second slot being received within the alignment holes formed in the second blade member, the upper portions of the mounting pins being reduced in diameter relative to the lower portions of said mounting pins, the upper portions of said mounting pins snap-fitting into the alignment apertures and alignment holes respectively, planar surfaces of the blade members abutting and being supported by substantially planar shoulder portions of the lower portions of the mounting pins, the mounting pins received within the alignment apertures of the first blade member being spaced apart a distance equal to the spacing of said alignment apertures, the mounting pins received within the alignment holes of the second blade member being spaced apart a distance equal to the spacing of said alignment holes, the spacing of the mounting pins and alignment apertures and holes preventing accidental interchange of the blade members on assembly or replacement of said blade members, the opposing edge surfaces of the first and second blade members gripping a screw cap on insertion of a container within the wedge opening to facilitate removal of the screw cap from the container.

2. In the opener of claim 1, wherein the improvement further comprises means for mounting the opener to the underside of a cabinet.

3. In the opener of claim 1, wherein the opposing edge surfaces of the blade members are angled relative to each other at an angle of 80°.

4. In the opener of claim 1, wherein the blade members are each provided with at least one lug formed on the planar surface thereof which abuts the support ridges, the lug positively retaining the blade member within said respective slots.

* * * * *